US006689989B2

(12) United States Patent
Irwin, Sr. et al.

(10) Patent No.: US 6,689,989 B2
(45) Date of Patent: Feb. 10, 2004

(54) HEATER FOR ELECTRIC BLANKET

(76) Inventors: Harold W. Irwin, Sr., 807 Prince Charles La., Schaumburg, IL (US) 60194; Kin Sang Cheng, House no. 29, 1 Street, Section C, Fairview Park, Yuen Long (HK); John Crawford, 1 Butler Drive, Hendon SA (AU)

( * ) Notice: Subject to any disclaimer, the term of this patent is extended or adjusted under 35 U.S.C. 154(b) by 0 days.

(21) Appl. No.: 10/100,393

(22) Filed: Mar. 18, 2002

(65) Prior Publication Data

US 2003/0173345 A1 Sep. 18, 2003

(51) Int. Cl.[7] ..... H05B 1/00

(52) U.S. Cl. ..... 219/212; 219/211; 219/528; 219/529; 219/549

(58) Field of Search ..... 219/212, 211, 219/217, 528, 529, 541, 545, 549; 392/425, 432, 435

(56) References Cited

U.S. PATENT DOCUMENTS 4,436,986 A * 3/1984 Carlson ..... 219/212
4,485,296 A * 11/1984 Ueda et al. ..... 219/212
4,547,658 A * 10/1985 Crowley ..... 219/212
4,549,074 A * 10/1985 Matsuo ..... 219/212
4,575,620 A * 3/1986 Ishi et al. ..... 219/549
5,403,992 A * 4/1995 Cole ..... 219/528
5,422,461 A * 6/1995 Weiss et al. ..... 219/212
5,708,256 A * 1/1998 Montagnino et al. ..... 219/212
5,770,836 A * 6/1998 Weiss ..... 219/212
6,097,009 A * 8/2000 Cole ..... 219/528
6,310,332 B1 * 10/2001 Gerrard ..... 219/212

* cited by examiner

*Primary Examiner*—Sang Y. Paik
*Assistant Examiner*—Fadi H. Dahbour
(74) *Attorney, Agent, or Firm*—Boyle Fredrickson Newholm Stein & Gratz S.C.

(57) ABSTRACT

An electric blanket connectable to a power source is provided. The electric blanket includes first and second heating wires connected in series and a monitoring wire positioned therebetween. The monitoring wire is engageable with at least one of the heating wires in response to a predetermined temperature. The cutout interconnects the heating wires to a power source. A monitoring circuit triggers the cutout so as to disconnect the heating wires from the power source in response to engagement of the monitoring wire with one of the heating wires.

24 Claims, 6 Drawing Sheets

HEATER FOR ELECTRIC BLANKET

FIELD OF THE INVENTION

This invention relates generally to electric blankets, and in particular, to an electric blanket incorporating an improved structure for heating the electric blanket and preventing the overheating of the same.

BACKGROUND AND SUMMARY OF THE INVENTION

In colder climates, electric blankets are often used to keep individuals warm. Typically, an electric blanket includes first and second sheets of cloth material having a heating structure captured therebetween. The heating structure includes a heating core wire connectable to an electrical power source through a controller. The controller allows a user to vary the magnitude of the electrical power provided to the heating core wire, and hence, to control the heat dissipated by the heating core wire and the temperature of the electric blanket.

The heating core wire is contained in an insulation sheath that is protected by a woven screen. In normal use, an electric blanket should be spread out over a large surface area, such as a bed, in order for the whole surface to dissipate the heat generated by the heating core wire. It can be appreciated that the maximum temperature reached by the heating core wire must be below the melting point of the insulation. However, the risk of an electric blanket overheating may be significant in those situations when the heating core wire is electrically coupled to the electrical power source and the electric blanket is folded onto itself so as to prevent the heat generated by the heating core wire to escape. In such a situation, a first layer of the folded electric blanket may heat an adjacent layer (and vice versa) to such point as to cause the electric blanket to reach a temperature that is capable of starting a fire. It is noted, however, that the insulation about the heating core wire must melt before the cloth layers of the electric blanket begin to char and a fire starts.

In order to prevent the possibility of a fire starting due to the overheating of the electric blanket, most electric blankets incorporate a protective fuse circuit. The protective fuse circuit is usually connected to the woven screen. If the heater core wire overheats, the insulation softens and melts such that the heater core wire engages the woven screen causing a short circuit. The protective fuse circuit disconnects the heating coil wire from the electrical power source in response to the short circuit.

By way of example, it is contemplated that the protective fuse circuit include series resistor-diode combinations connected to corresponding ends of the woven screen. The resistors of the resistor-diode combinations are positioned adjacent a thermal fuse. In response to a short circuit between the heating core wire and the woven screen anywhere along the length of the heating core wire, current will flow through the resistor-diode combinations so as to heat the resistors. The thermal fuse is actuated by the dissipation of heat in the resistors so as to disconnect the heating coil wire from the electrical power source. It is noted that the conductive directions of the diodes of the resistor-diode combinations are opposed in order to prevent current flow through the protective fuse circuit unless there is a short circuit between the heating core wire and the woven screen. While functional for their intended purpose, these prior heating structures used in the electric blankets are relatively expensive. As such, it would be highly desirable to provide an electric blanket that utilizes less expensive components than prior electric blankets.

For electric blankets to be used on double beds, an additional design criteria must be considered. More specifically, multiple users of a single electric blanket may desire the electric blanket to be set to different temperatures. As such, electric blankets are often provided with independent heater structures and controllers for each side of the electric blanket. It can be appreciated that this type of arrangement requires a separate power outlet for each side of the electric blanket and/or additional pairs of wires directed to the heating structures for each side of the electric blanket. Therefore, it would be highly desirable to provide an electric blanket that uses a minimum number of wires and that has a single power outlet, but still allows for the independent control of the temperatures for each side of the electric blanket.

Therefore, it is a primary object and feature of the present invention to provide an electric blanket that utilizes a minimum number of wires and a less expensive components than prior electric blankets.

It is a further object and feature of the present invention to provide an electric blanket that allows for the independent control of the temperatures for each side of the electric blanket and that utilizes a single power outlet.

It is a still further object and feature of the present invention to provide an electric blanket that is simple and inexpensive to manufacture.

In accordance with the present invention, an electric blanket is provided. The electric blanket includes a first core wire having first and second ends. A second core wire is positioned adjacent the first core wire. The second core wire engages the first core wire in response to a predetermined temperature. A cutout is operatively connected to the first end of the first core wire. The cutout is movable between a first connected state wherein the cutout electrically couples the first end of the first core wire to a variable power source and the second disconnected state wherein the cutout disconnects the first end of the first core from the variable power source. A monitoring circuit is operatively connected to the second core wire. The monitoring circuit moves the cutout between the connected state and the disconnected state in response to engagement of the second core wire and the first core wire.

The first and second core wires are wrapped in insulation. The insulation melts in response to exposure to a predetermined temperature. The second core wire has first and second ends. The monitoring circuit includes a first resistor and diode combination interconnecting the first end of the second core wire and a neutral point. The monitoring circuit further includes a second resistor and diode combination interconnecting the second end of the second core wire and the first end of the first core wire. The first and second resistor and diode combinations are interconnected in series. The diodes of the resistor and diode combinations have predetermined conductive directions and the conductive directions of the diodes of the resistor and diode combinations are opposed. It is contemplated to position the cutout in close proximity to the resistors of the first and second resistor and diode combinations.

The electric blanket may also include a third core wire positioned adjacent the second core wire. The third core wire has a first end operatively connected to the second end of the first core wire and a second end operatively connected to a neutral point. The monitoring circuit moves the cutout between the connected state and the disconnected state in response to engagement of the second core wire and the third core wire. The cutout may include a thermal fuse.

In accordance with a further aspect of the present invention, an electric blanket is provided. The electric blanket includes a first heater having a first heating wire, a second heating wire and a monitoring wire. The first heating wire has a first end and a second end. The second heating wire has a first end operatively connected to the second end of the first heating wire and a second end operatively connected to a first neutral point. The monitoring wire is positioned between the first and second heating wires. The monitoring wire is engageable with the first and second heating wires in response to a predetermined temperature. A cutout is operatively connected to the first end of the first heating wire. The cutout is movable between the first connected state wherein the cutout electrically couples the first end of the heating wire to a variable power source and a second connected state wherein the cutout disconnects the first end of the first heating wire from the variable power source. A monitoring circuit is operatively connected to the monitoring wire. The monitoring circuit moves the cutout between the connected state and the disconnected state in response to engagement of the monitoring wire with one of the heating wires.

The electric blanket may also include a second heater. The second heater has a first heating wire, a second heating wire and a monitoring wire. The first heating wire of the second heater has first and second ends. The second heating wire of the second heater has a first end operatively connected to the second end of the first heating wire of the second heater and a second end operatively connected to a second neutral point. The monitoring wire of the second heater is positioned between the first and second heating wires of the second heater. The monitoring wire of the second heater is engageable with the first and second heating wires of the second heater in response to a predetermined temperature.

The cutout of the electric blanket is operatively connected to the first end of the first heating wire of the second heater such that with the cutout in the first connected state, the cutout electrically couples the first end of the first heating wire of the second heater to the variable power source, and with the cutout in the second disconnected state, the cutout disconnects the first end of the first heating wire of the second heater from the variable power source.

The electric blanket may also include a second monitoring circuit operatively connected to the monitoring wire of the second heater. The second monitoring circuit moves the cutout between the connected state and the disconnected state in response to engagement of the monitoring wire of the second heater with one of the heating wires of the second heater.

The monitoring wire of the first heater has first and second ends. The first monitoring circuit includes a first resistor in diode combination interconnecting the first end of the monitoring wire of the first heater and a second neutral point. The resistor and the diode of the first resistor and diode combination are operatively connected at a node. A second resistor and diode combination interconnects the second end of the monitoring wire of the first heater and the first end of the first heating wire of the first heater. The monitoring wire of the second heater has first and second ends. The first resistor and diode combination interconnects the first end of the monitoring wire of the second heater and the second neutral point. The second resistor and diode combination interconnects the second end of the monitoring wire of the second heater and the first end of the first heating wire of the first heater. The first and second resistor and diode combinations are connected in series. The diodes of the resistor and diode combinations have predetermined conductive directions. The conductive directions of the diodes of the resistor and diode combinations are opposed. A fault current diode having a predetermined conductive direction may be interconnected to the first neutral point and the node. The conductive direction of the fault current diode and the conductive direction of the diode of the first resistor and diode combination are opposed.

In accordance with a further aspect of the present invention, an electric blanket is provided. The electric blanket is connected to a power source for providing voltage and current thereto. The electric blanket includes a first heater having a first end connectable to the power source and a second end connectable to a first neutral point. The first heater includes first and second heating elements connected in series. A first monitoring wire is disposed between the first and second heating elements. The first monitoring wire is engageable with a least one of the heating elements in response to a predetermined temperature. A monitoring circuit is operatively connected to the first monitoring wire and to the power source. The monitoring circuit disconnects the first heater from the power source in response to the first monitoring wire engaging at least one of the heating elements.

The electric blanket may also include a second heater having a first end connectable to the power source and a second end connectable to a second neutral point. The second heater includes first and second heating elements connected in series. A second monitoring wire is disposed between the first and second heating elements of the second heater. The second monitoring wire is engageable with at least one of the heating elements of the second heater in response to a predetermined temperature. A second monitoring circuit may be operatively connected to the second monitoring wire and to the power source. The second monitoring circuit disconnects the first heater from the power source in response to the second monitoring wire engaging at least one of the heating elements of the second heater.

It is contemplated to interconnect the first end of the first heater and the first end of the second heater at a heater node. The first end of the monitoring wire and the first end of the second monitoring wire may be operatively connected at a first monitoring wire node. The second end of the first monitoring wire and the second end of the second monitoring wire may be operatively connected at a second monitoring wire node. A first resistor and diode combination interconnects the first monitoring wire node and the second neutral point. The resistor and the diode of the first resistor and diode combination are operatively connected at a resistor-diode node. A second resistor and diode combination interconnects the second monitoring wire node and the heater node. The first and second resistor and diode combinations are connected in series. The diodes of the resistor and diode combinations have predetermined conductive directions. The conductive directions of the diodes of the resistor and diode combinations are opposed.

It is contemplated that the electric blanket include a fault current diode having a predetermined conductive direction. The fault current diode interconnects the first neutral point and the resistor-diode node. The conductive direction of the fault current diode and a conductive direction of the diode of the first resistor and diode combination are opposed.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE INVENTION

Figure 1:
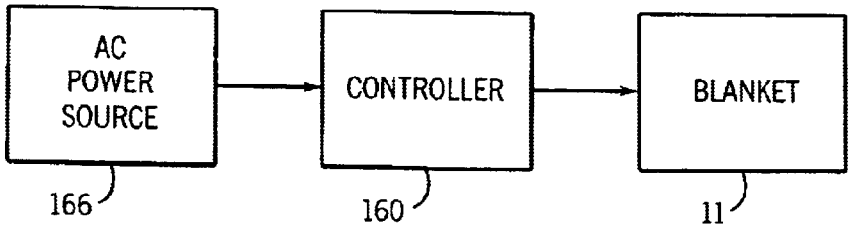
FIG. 1 is a schematic of an electric blanket and controller therefore in accordance with the present invention.
Figure 2:
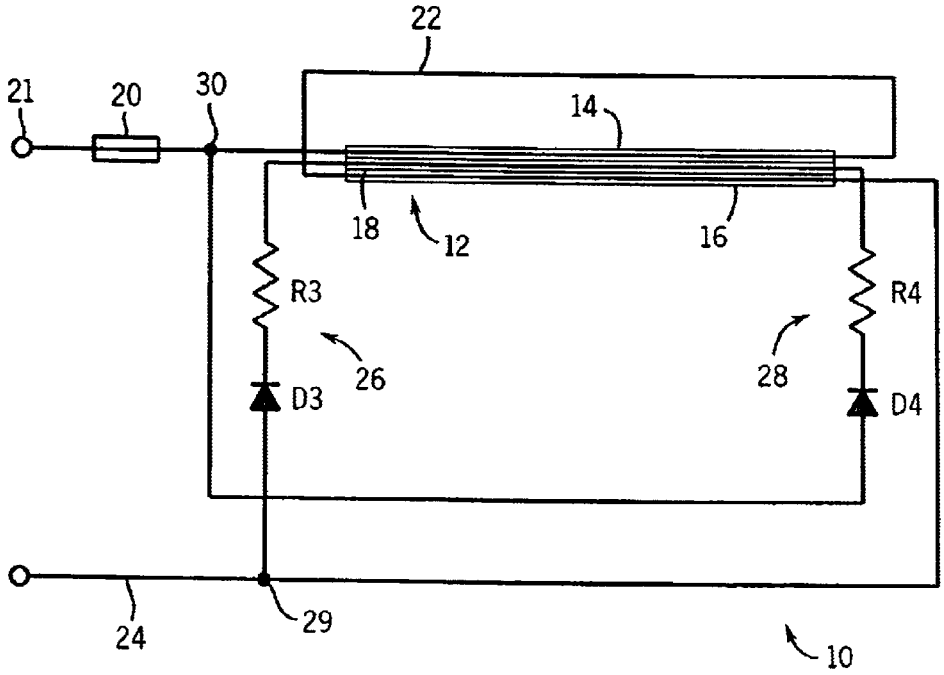
FIG. 2 is a schematic of a first embodiment of a heating structure for an electric blanket in accordance with the present invention.

Referring to FIG. 1, a schematic of an electric blanket 11 and a controller therefore is depicted. As is conventional, electric blanket 11 includes first and second layers having a heating structure therebetween. As best seen in FIG. 2, a first embodiment of a heating structure for electric blanket 11 is generally designated by the reference numeral 10. Heating structure 10 includes three-wire heating element 12 having first and second outer core wires 14 and 16, respectively, and central core wire 18 extending parallel to each other. It is intended that outer core wires 14 and 16 generate heat in response to the flow of current therethough and that central core wire 18 be interconnected to a protection circuit, as hereinafter described. Outer core wires 14 and 16 and central core wire 18 are wrapped by corresponding insulation sheaths that melt in response to exposure to a predetermined temperature such that outer core wires 14 and 16 come into electrical contact with central core wire 18.

A thermal cutout, such as thermal fuse 20, interconnects a first end of first outer wire 14 and input 21, as hereinafter described, such that AC power may be supplied to first outer core wire 14. The second end of first outer core wire 14 is electrically coupled to the first end of second outer core wire 16 by line 22 such that first and second outer core wires 14 and 16, respectively, are connected in series. The second end of second outer core wire 16 is operatively connected to neutral line 24. As described, the AC electrical power provided at the first end of first outer core wire 14 flows through the first and second outer core wires 14 and 16, respectively, in the same direction such that half of the AC supply voltage is dropped across each outer core wire 14 and 16.

The protective circuit of heating structure 10 includes first and second resistor-diode combinations 26 and 28, respectively, that are connected to corresponding ends of central core wire 18. First resistor-diode combination 26 includes resistor R3 connected to a first end of central core wire 18 and a diode D3 connected to neutral line 24 at node 29. Second resistor-diode combination 28 includes resistor R4 connected to a second end of central core wire 18 and diode D4 connected to the first end of first outer core wire 14 at node 30. The conductive directions of the diodes D3 and D4 of resistor-diode combinations 26 and 28, respectively, are opposed in order to prevent current flow through resistor-diode combinations 26 and 28 unless there is a short circuit between outer core wires 14 and 16 and central core wire 18.

Resistors R3 and R4 of first and second resistor-diode combinations 26 and 28, respectively, are positioned adjacent thermal fuse 20 such that thermal fuse 20 may be tripped by the heat dissipated in the resistors R3 and R4. In addition, the resistance values of resistors R3 and R4 of first and second resistor-diode combinations 26 and 28, respectively, must be of sufficient magnitude that the power dissipated by resistors R3 and R4 can heat thermal fuse 20 to its trip temperature within a reasonable time period. It can be appreciated that the power dissipated by resistors R3 and R4 will vary in response to the location of a short circuit between outer core wires 14 and 16 and central core wire 18. Hence, the maximum power dissipated by the resistors R3 and R4 should not exceed the over-power rating of the resistors such that the resistors R3 and R4 may fail.

In operation, AC electrical power is provided to input 21 of heating structure 10 such that AC current flows through first and second outer core wires 14 and 16, respectively. As heretofore described, a voltage drop occurs across each of outer core wires 14 and 16 that, in turn, causes heating structure 10 to dissipate heat. The heat dissipated by outer core wires 14 and 16 warms electric blanket 11.

In the event that an overheating situation occurs such that the temperatures of outer core wires 14 or 16 exceed the predetermined melting point of the insulation sheaths, the insulation sheaths about outer core wires 14 and 16 and central core wire 18 melt such that outer core wires 14 and 16 come into electrical contact with central core wire 18 causing a short circuit. In response to a short circuit between the outer core wires 14 and 16 and central core wire 18, AC current will flow through resistor-diode combinations 26 and 28 such that resistors R3 and R4, respectively, begin to dissipate heat. Thermal fuse 20 is tripped by the heat dissipated by resistors R3 and R4, as heretofore described, so as to create an open circuit between input 21 and the first end of first outer coil wire 14 thereby disconnecting the outer core wires 14 and 16 from the AC power source and terminating the overheating condition of electric blanket 11.

Referring to FIG. 2, an alternate embodiment of a heating structure for electric blanket 11 is generally designated by the reference numeral 30. It is intended that heating structure 30 include first and second heaters 32 and 34, respectively, for independently heating opposite sides of electric blanket 11. First heater 32 includes three-wire heating element 36 having first and second outer core wires 38 and 40, respectively, and central core wire 42 extending parallel to each other. It is intended that outer core wires 38 and 40 generate heat in response to the flow of current therethough and that central core wire 42 be interconnected to a protection circuit, as hereinafter described. Outer core wires 38 and 40 and central core wire 42 are wrapped by corresponding insulation sheaths that melt in response to exposure to a predetermined temperature such that outer core wires 38 and 40 come into electrical contact with central core wire 42.

A thermal cutout, such as thermal fuse 44, interconnects a first end of first outer wire 38 and an input 46 to heating structure 30, as hereinafter described, such that AC power may be supplied to first outer core wire 38. The second end of first outer core wire 38 is electrically coupled to the first end of second outer core wire 40 by line 48 such that first and second outer core wires 38 and 40, respectively, are connected in series. The second end of second outer core wire 40 is operatively connected to first side neutral line 50. As described, the AC current provided at the first end of first outer core wire 38 flows through the first and second outer core wires 38 and 40, respectively, in the same direction such that half of the AC supply voltage is dropped across each outer core wires 38 and 40.

The protection circuit for first heater 32 includes first and second resistor-diode combinations 52 and 54, respectively, that are connected to corresponding ends of central core wire 42. First resistor-diode combination 52 includes resistor R5 connected to a first end of central core wire 40 and diode D5 connected to first side neutral line 50 at node 56. Second resistor-diode combination 54 includes resistor R6 connected to a second end of central core wire 40 and diode D6 connected at node 60 to line 58 that is connected, in turn, to the first end of first outer core wire 40 at node 62. The conductive directions of the diodes D5 and D6 of resistor-diode combinations 52 and 54, respectively, are opposed in order to prevent current flow through resistor-diode combinations 52 and 54 unless there is a short circuit between outer core wires 38 and 40 and central core wire 42.

Resistors R5 and R6 of first and second resistor-diode combinations 52 and 54, respectively, are positioned adjacent thermal fuse 44 such that thermal fuse 44 may be tripped by the heat dissipated in the resistors R5 and R6. In addition, the resistance values of resistors R5 and R6 of first and second resistor-diode combinations 52 and 54, respectively, must be of sufficient magnitude that the power dissipated by resistors R5 and R6 can heat thermal fuse 44 to its trip temperature within a reasonable time period. It can be appreciated that the power dissipated by resistors R5 and R6 will vary in response to the location of a short circuit between outer core wires 38 and 40 and central core wire 42. Hence, the maximum power dissipated by the resistors R5 and R6 should not exceed the over-power rating of the resistors such that resistors R5 and R6 may fail.

Second heater 34 includes three-wire heating element 66 having first and second outer core wires 68 and 70, respectively, and central core wire 72 extending parallel to each other. It is intended that outer core wires 68 and 70 generate heat in response to the flow of current therethough and that central core wire 72 be interconnected to a protection circuit, as hereinafter described. Outer core wires 68 and 70 and central core wire 72 are wrapped by corresponding insulation sheaths that melt in response to exposure to a predetermined temperature such that outer core wires 68 and 70 come into electrical contact with central core wire 72.

A first end of first outer wire 68 is operatively connected at node 73 to line 58 that is connected, in turn, to a first end of first outer core wire 40 of first heater 32 at node 62 such that AC power may be supplied to first outer core wire 68. A second end of first outer core wire 68 is electrically coupled to the first end of second outer core wire 70 by line 78 such that first and second outer core wires 68 and 70, respectively, are connected in series. The second end of second outer core wire 70 is operatively connected to second side neutral line 80. As described, the AC current provided at the first end of first outer core wire 68 flows through the first and second outer core wires 68 and 70, respectively, in the same direction such that half of the AC supply voltage is dropped across each outer core wire 68 and 70.

The protective circuit of second heater 34 includes first and second resistor-diode combinations 82 and 84, respectively, that are connected to corresponding ends of central core wire 72. First resistor-diode combination 82 includes resistor R7 connected to a first end of central core wire 70 and diode D7 connected to second side neutral line 80 at node 86. Second resistor-diode combination 84 includes resistor R8 connected to a second end of central core wire 70 and diode D8 connected at node 73 to line 58 that is connected, in turn, to first end of first outer core wire 70 at node 62. The conductive directions of diodes D7 and D8 of resistor-diode combinations 82 and 84, respectively, are opposed in order to prevent current flow through resistor-diode combinations 82 and 84 unless there is a short circuit between outer core wires 68 and 70 and central core wire 72.

Resistors R7 and R8 of first and second resistor-diode combinations 82 and 84, respectively, are positioned adjacent thermal fuse 44 such that thermal fuse 44 may be tripped by the heat dissipated in the resistors R7 and R8. In addition, the resistance values of resistors R7 and R8 of first and second resistor-diode combinations 82 and 84, respectively, must be of sufficient magnitude that the power dissipated by resistors R7 and R8 can heat thermal fuse 44 to its trip temperature within a reasonable time period. It can be appreciated that the power dissipated by resistors R7 and R8 will vary in response to the location of a short circuit between outer core wires 68 and 70 and central core wire 72. Hence, the maximum power dissipated by the resistors R7 and R8 should not exceed the over-power rating of the resistors such that the resistors R7 and R8 may fail.

In operation, AC electrical power is provided to input 46 of heating structure 30 such that AC current flows through first and second outer core wires 38 and 40, respectively, and through first and second outer core wires 68 and 70, respectively, of second heater 34. As heretofore described, a voltage drop occurs across outer core wires 38 and 40 of first heater 32 that, in turn, dissipate heat on a first side of electric blanket 11. Similarly, a voltage drop occurs across outer core wires 68 and 70 of second heater 34 that, in turn, dissipate heat on a second side of electric blanket 11.

In the event that an overheating situation occurs on the first side of electric blanket 11 such that the temperatures of outer core wires 38 or 40 of first heater 32 exceed the predetermined melting point of the insulation sheaths, the insulation sheaths about outer core wires 38 and 40 and central core wire 42 of first heater 32 melt such that outer core wires 38 and 40 of first heater 32 come into electrical contact with central core wire 42 of first heater 32 causing a short circuit. In response to a short circuit between the outer core wires 38 and 40 and central core wire 42 of first heater, AC current will flow through resistor-diode combinations 52 and 54 such that resistors R5 and R6, respectively, begin to dissipate heat. Thermal fuse 44 is tripped by the heat dissipated by resistors R5 and R6, as heretofore described, so as to create an open circuit between input 46 and node 62 thereby disconnecting first and second heaters 32 and 34, respectively, from the AC power source and terminating the overheating condition of electric blanket 11.

In the event that an overheating situation occurs on the second side of electric blanket 11 such that the temperatures of outer core wires 68 and 70 of second heater 34 exceed the predetermined melting point of the insulation sheaths, the insulation sheaths about outer core wires 68 and 70 and central core wire 72 of second heater 34 melt such that outer core wires 68 and 70 of second heater 34 come into electrical contact with central core wire 72 of second heater 34 causing a short circuit. In response to a short circuit between the outer core wires 68 and 70 and central core wire 72 of second heater 34, AC current will flow through resistor-diode combinations 82 and 84 such that resistors R7 and R8, respectively, begin to dissipate heat. Thermal fuse 44 is tripped by the heat dissipated by resistors R7 and R8, as heretofore described, so as to create an open circuit between input 46 and node 62 thereby disconnecting first and second heaters 32 and 34, respectively, from the AC power source and terminating the overheating condition of electric blanket 11.

Figure 3:
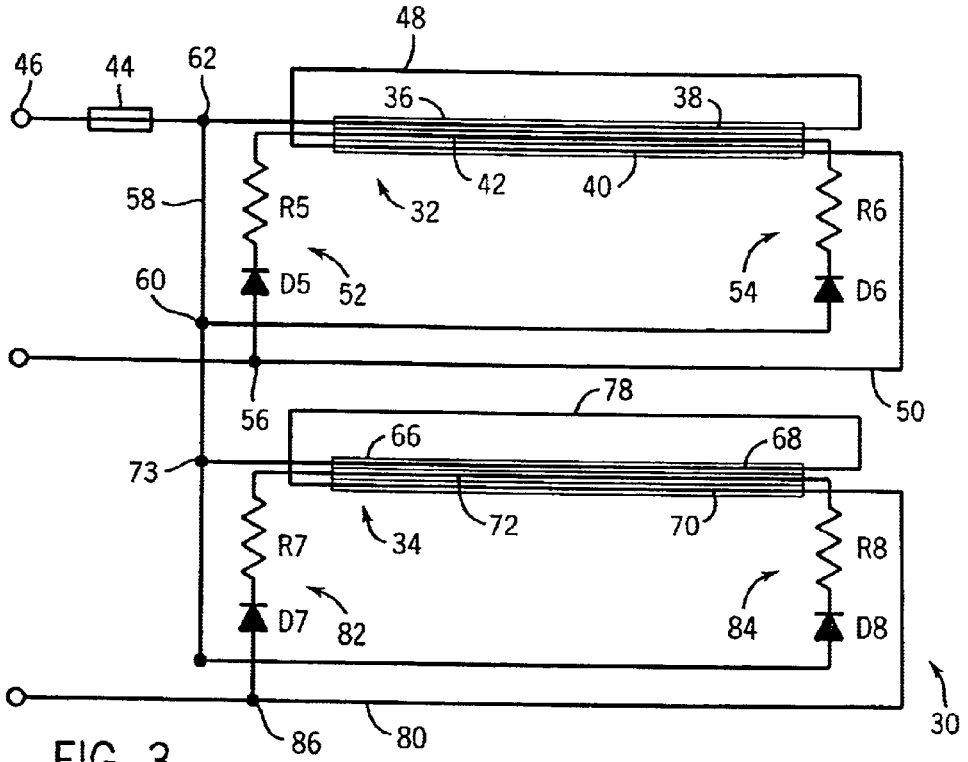
FIG. 3 is a schematic view of a second embodiment of a heating structure for an electric blanket in accordance with the present invention.
Figure 4:
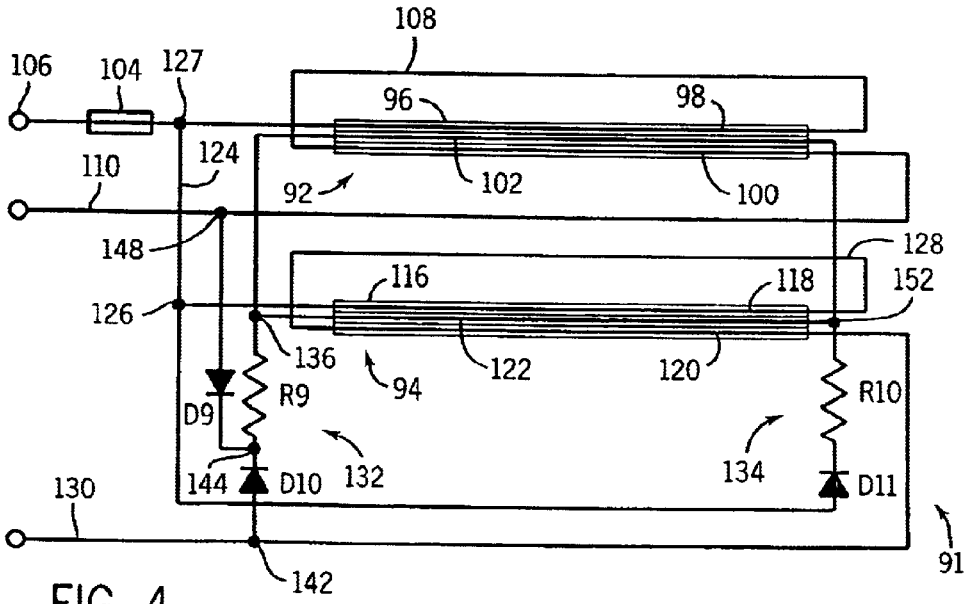
FIG. 4 is a schematic view of a third embodiment of a heating structure for an electric blanket in accordance with the present invention.

Referring to FIG. 3, an alternate embodiment of a heating structure for electric blanket 11 is generally designated by the reference numeral 91. It is intended that heating structure 91 include first and second heaters 92 and 94, respectively, for independently heating opposite sides of electric blanket 11. First heater 92 includes three-wire heating element 96 having first and second outer core wires 98 and 100, respectively, and central core wire 102 extending parallel to each other. It is intended that outer core wires 98 and 100 generate heat in response to the flow of current therethough and that central core wire 102 be interconnected to a protection circuit, as hereinafter described. Outer core wires 98 and 100 and central core wire 100 are wrapped by corresponding insulation sheaths that melt in response to exposure to a predetermined temperature such that outer core wires 98 and 100 come into electrical contact with central core wire 102.

A thermal cutout, such as thermal fuse 104, interconnects a first end of first outer wire 98 and input 106 to heating structure 91 as hereinafter described, such that AC power may be supplied to first outer core wire 98. A second end of first outer core wire 98 is electrically coupled to the first end of second outer core wire 100 by line 108 such that first and second outer core wires 98 and 100, respectively, are connected in series. The second end of second outer core wire 100 is operatively connected to first side neutral line 110. As described, the AC current provided at the first end of first outer core wire 98 flows through the first and second outer core wires 98 and 100, respectively, in the same direction such that half of the AC supply voltage is dropped across each outer core wires 98 and 100.

Second heater 94 includes three-wire heating element 116 having first and second outer core wires 118 and 120, respectively, and central core wire 122 extending parallel to each other. It is intended that outer core wires 118 and 120 of second heater 94 generate heat in response to the flow of current therethough and that central core wire 122 of second heater 94 be interconnected to the protection circuit, as hereinafter described. Outer core wires 118 and 120 and central core wire 122 of second heater 94 are wrapped by corresponding insulation sheaths that melt in response to exposure to a predetermined temperature such that outer core wires 118 and 120 come into electrical contact with central core wire 122.

A first end of first outer wire 118 of second heater 94 is operatively connected at node 126 to line 124 that is connected, in turn, to first end of first outer core wire 100 of first heater 92 at node 127 such that AC power may be supplied to first outer core wire 118. A second end of first outer core wire 118 of second heater 94 is electrically coupled to the first end of second outer core wire 120 of second heater 94 by line 128 such that first and second outer core wires 118 and 120, respectively, are connected in series. The second end of second outer core wire 120 of second heater 94 is operatively connected to second side neutral line 130. As described, the AC current provided at the first end of first outer core wire 118 of second heater 94 flows through the first and second outer core wires 118 and 120, respectively, of second heater 94 in the same direction such that half of the AC supply voltage is dropped across each outer core wires 118 and 120 of second heater 94

The protection circuit of heating structure 91 includes first and second resistor-diode combinations 132 and 134, respectively. First resistor-diode combination 132 is connected to first ends of central core wires 102 and 122 of first and second heaters 92 and 94, respectively, at node 136. First resistor-diode combination 132 includes resistor R9 connected to node 136 and diode D10 connected to second side neutral line 130 at node 142. Resistor R9 and diode D10 are connected at node 144. Node 144 is connected to first side neutral line 110 at node 148 by diode D9.

Second resistor-diode combination 134 is connected to second ends of central core wires 102 and 122 of first and second heaters 92 and 94, respectively, at node 152. Second resistor-diode combination 134 includes resistor R10 connected to node 152 and diode D11 connected at node 126 to line 124 that is connected, in turn, to first end of first outer core wire 98 of first heater 92 at node 127. The conductive directions of diodes D10 and D11 of resistor-diode combinations 132 and 134, respectively, are opposed in order to prevent current flow through resistor-diode combinations 132 and 134 unless there is a short circuit between outer core wires 98 and 100 and central core wire 102 of first heater 92 or there is a short circuit between outer core wires 118 and 120 and central core wire 122 of second heater 94. Similarly, the conductive directions of diodes D9 and D11 of second resistor-diode combination 134 are opposed in order to prevent current flow through diode D9 and second resistor-diode combination 134 unless there is a short circuit between outer core wires 98 and 100 and central core wire 102 of first heater 92 or there is a short circuit between outer core wires 118 and 120 and central core wire 122 of second heater 94.

Resistors R9 and R10 of first and second resistor-diode combinations 132 and 134, respectively, are positioned adjacent thermal fuse 104 such that thermal fuse 104 may be tripped by the heat dissipated in the resistors R10 and R11. In addition, the resistance values of resistors R10 and R11 of first and second resistor-diode combinations 132 and 134, respectively, must be of sufficient magnitude that the power dissipated by resistors R10 and R11 can heat thermal fuse 104 to its trip temperature within a reasonable time period. It can be appreciated that the power dissipated by resistors R10 and R11 will vary in response to the location of a short circuit between outer core wires 98 and 100 and central core wire 102 of first heater 92 or to the location of a short circuit between outer core wires 118 and 120 and central core wire 122 of second heater 94. Hence, the maximum power dissipated by the resistors R10 and R11 should not exceed the over-power rating of the resistors such that the resistors R10 and R11 may fail.

In operation, if an overheating situation occurs on the first side of electric blanket 11 such that the temperatures of outer core wires 98 and 100 of first heater 92 exceed the predetermined melting point of the insulation sheaths, the insulation sheaths about outer core wires 98 and 100 and central core wire 102 of first heater 92 melt such that outer core wires 98 and 100 of first heater 92 come into electrical contact with central core wire 102 of first heater 92 causing a short circuit. In response to a short circuit between the outer core wires 98 and 100 and central core wire 102 of first heater 92, AC current will flow through resistor-diode combinations 132 and 134 such that resistors R9 and R10, respectively, begin to dissipate heat. Thermal fuse 104 is tripped by the heat dissipated by resistors R9 and R10, as heretofore described, so as to create an open circuit between input 106 and node 127 thereby disconnecting first and second heaters 92 and 94, respectively, from the AC power source and terminating the overheating condition of electric blanket 11.

Similarly, if an overheating situation occurs on the second side of the electric blanket such that the temperatures of outer core wires 118 and 120 of second heater 94 exceed the predetermined melting point of the insulation sheaths, the insulation sheaths about outer core wires 118 and 120 and central core wire 122 of second heater 94 melt such that outer core wires 118 and 120 of second heater 94 come into electrical contact with central core wire 122 of second heater 94 causing a short circuit. In response to a short circuit between the outer core wires 118 and 120 and central core wire 122 of second heater 92, AC current will flow through resistor-diode combinations 132 and 134 such that resistors R9 and R10, respectively, begin to dissipate heat. Thermal fuse 104 is tripped by the heat dissipated by resistors R9 and R10, as heretofore described, so as to create an open circuit between input 106 and node 127 thereby disconnecting first and second heaters 92 and 94, respectively, from the AC power source and terminating the overheating condition of electric blanket 11.

Figure 5:
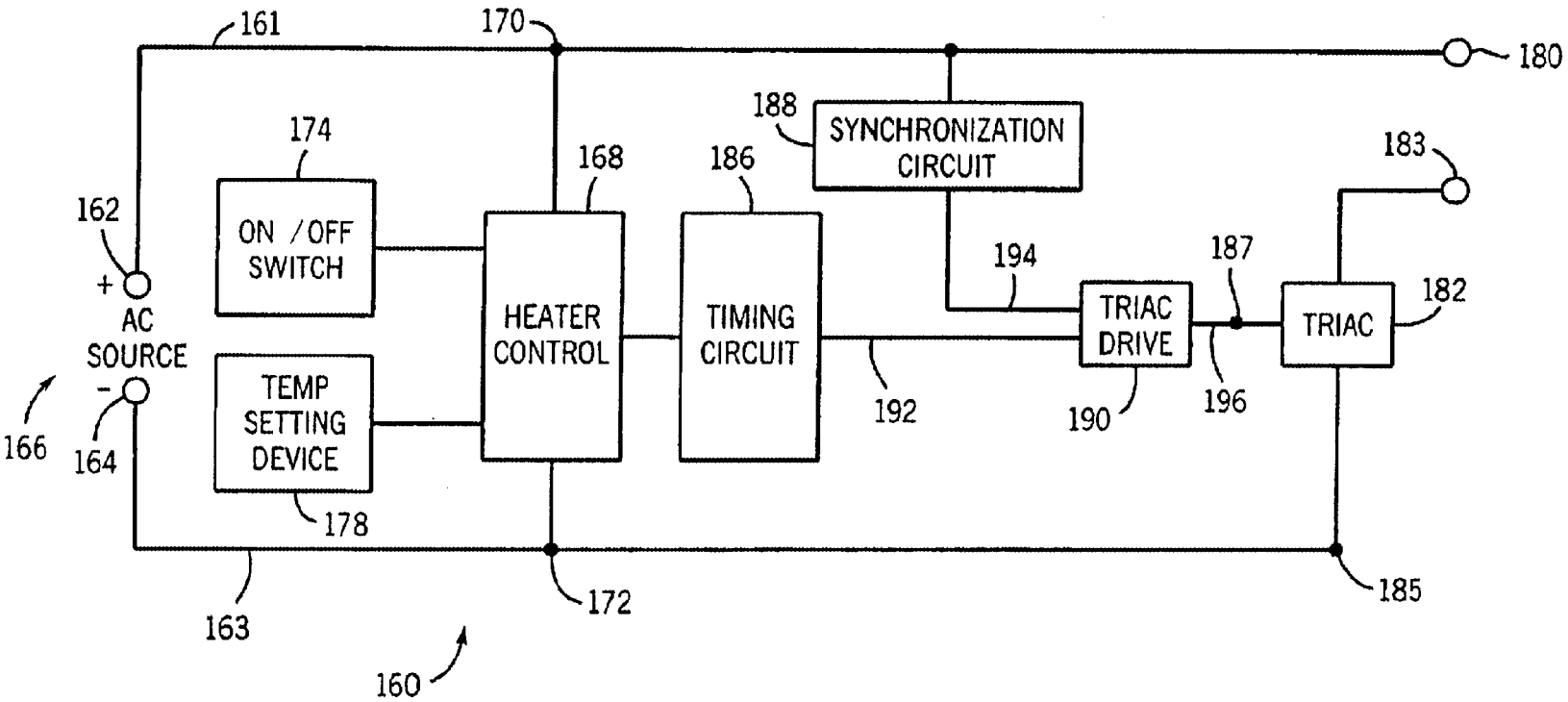
FIG. 5 is a schematic view of a controller for the heating structure of FIG. 1.

Referring to FIG. 5, a controller for controlling operation of heating structure 10 of electric blanket 11 is generally designated by the reference numeral 160. Controller 160 includes lines 161 and 163 having first ends terminating at input terminals 162 and 164, respectively, that are connectable to a conventional AC power source 166. Line 161 of controller 160 has a second, opposite end 180 that is electrically coupled to input 21 of heating structure 10, FIG. 2.

Controller 160 further includes triac 182 having a first terminal 183 interconnected to neutral line 24 of heating structure 10; a second terminal 185 interconnected to line 163 of controller 160; and third gate terminal 187. Triac 182 controls the flow of current between the first and second terminals 183 and 185, respectively, in response to predetermined switching signals provided at gate terminal 187. Triac 182 has a first non-conducting state wherein triac 182 acts like an open circuit and a second conducting state wherein triac 182 electrically connects neutral line 24 of heating structure 10, FIG. 2, and line 163 and allows for the flow of current between first and second terminals 183 and 185, respectively, during both alternations of an AC cycle. It can be appreciated that by controlling the flow of current through heating element 12 of heating structure 10, the heat dissipated by heating element 12, and hence, the temperature of electric blanket 11, may be controlled.

Two alternate methods for controlling the current through heating element 12 are contemplated. In accordance with one such method, triac 182 may be triggered to the conducting state at predetermined time intervals such that predetermined portions of the AC sine wave cycles flow through triac 182. Alternatively, triac 182 may be triggered to the conducting state for a predetermined number of AC cycles or a predetermined time period. Thereafter, triac 182 returns to the non-conducting state for a second predetermined number of AC cycles or a second predetermined time period. Over time, each of the methods allow for the same amount of power to be provided to heating element 12. However, the second method has the added feature of allowing linear control of the power supplied to the heating element 12. Since each half cycle of the sinusoidal AC voltage will provide the same power, varying the number of half cycles will proportionally increase or decrease the power supplied.

The switching signals for controlling operation of triac 182 are generated by heater control 168; timing circuit 186; and synchronization circuit 188. Heater control 168 is electrically connected to line 161 at node 170 and to line 163 at node 172. Heater control 168 includes on/off switch 174 for allowing a user to actuate heating structure 10, as hereinafter described. In addition, heater control 168 includes temperature setting device 178 for allowing a user to control the heat dissipated by heating element 12 of heating structure 10.

Timing circuit 186 is operatively connected heater control 168 and generates timing signals on line 192 in response to actuation of the on/off switch 174 and the temperature setting of temperature setting device 178. Synchronization circuit 188 is operatively connected to line 161 to monitor the zero crossing times of the electrical power supplied to input 21 of heating structure 10 and provides such information as synchronizing signals to triac drive 190 on line 194. Triac drive 190 receives the timing signals from timing circuit 186 on line 192 and the synchronizing signals from synchronization circuit 188 on line 194. Triac drive 190 synchronizes the timing signals generated by timing circuit 186 with the zero crossing times of the electrical power supplied to heating structure 10 and generates switching signals in response thereto. By synchronizing the timing signals generated by timing circuit 186 with the zero crossing times of the electrical power, triac drive 190 insures that the switching signals provided to gate terminal 187 of triac 182 on line 196 trigger triac 182 to the conductive state at equal positive or negative thresholds about the zero crossing times of the electrical power.

Figure 6:
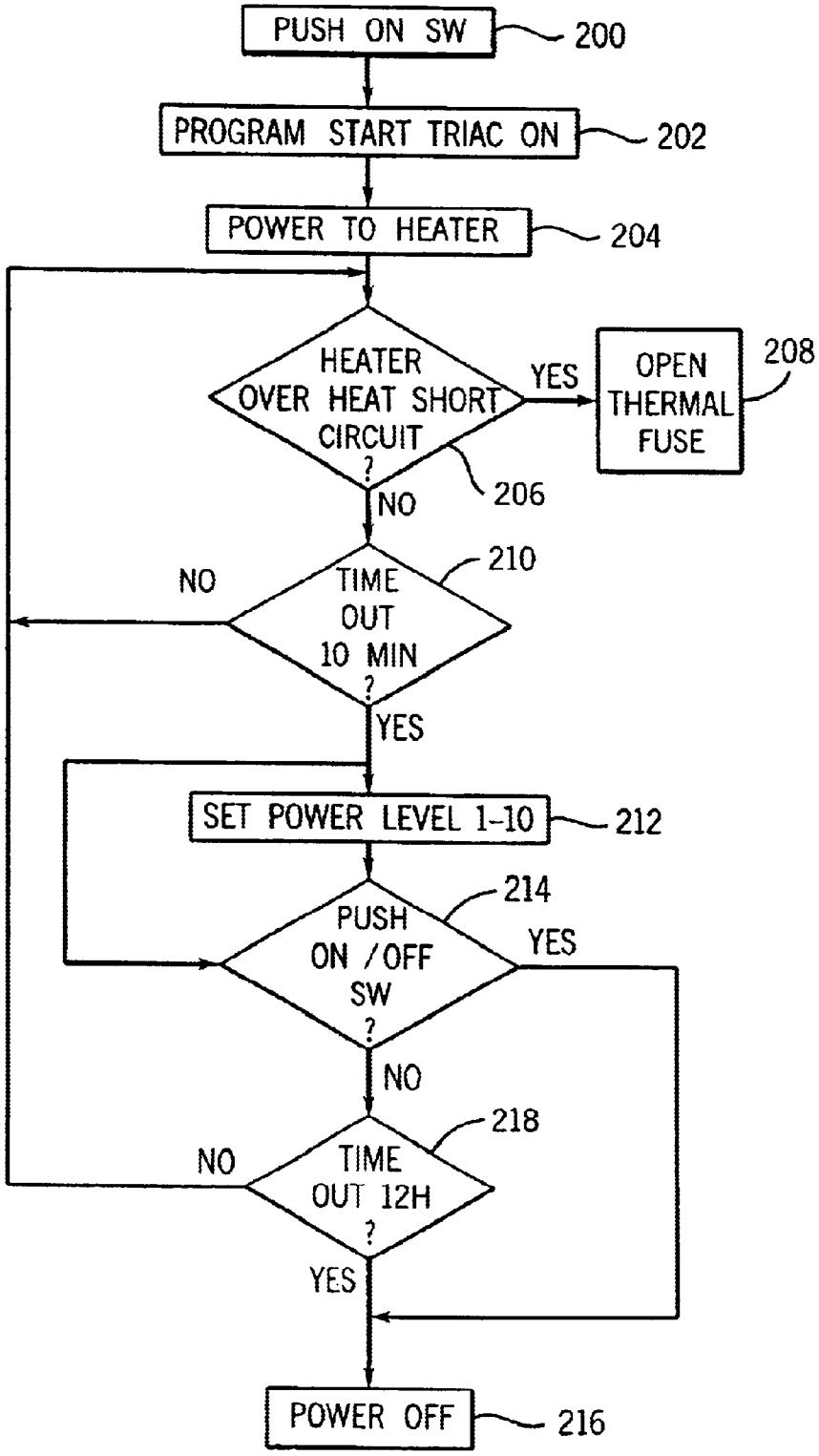
FIG. 6 is a flow chart of a method of controlling the heating structure of FIG. 1.

Referring to FIG. 6, in operation, a user activates controller 160 by actuating on/off switch 174 of heater control 168 to the on position, block 200. With on/off switch 174 in the on position, timing circuit 186 generates a corresponding timing signal instructing triac drive 190 to switch triac 182 to the conducting state for a predetermined period of time, block 202, in order to allow for the flow of current through heating element 12 to preheat electric blanket 11 to a minimum level, block 204. By way of example, triac 182 may be maintained in the conducting state for a period of ten (10) minutes.

As heretofore described, the protective circuit of heating structure 10 monitors the temperature of heating element 12, block 206. If the temperatures of outer core wires 14 or 16 exceed the predetermined melting point of the insulation sheaths, the insulation sheaths about outer core wires 14 and 16 and central core wire 18 melt such that outer core wires 14 and 16 come into electrical contact with central core wire 18 causing a short circuit. In response to a short circuit between the outer core wires 14 and 16 and central core wire 18, AC current will flow through resistor-diode combinations 26 and 28 such that resistors R3 and R4, respectively, begin to dissipate heat. Thermal fuse 20 is tripped by the heat dissipated by resistors R3 and R4, as heretofore described, so as to create an open circuit between input 21 and the first end of first outer coil wire 14 thereby disconnecting the outer core wires 14 and 16 from the AC power source and terminating the overheating condition of electric blanket, block 208.

If no overheating condition occurs during the preheating of heater element 12 during the predetermined time period, block 210, timing circuit 186 monitors the temperature setting of temperature setting device 178, block 212. Each temperature setting corresponds to triac 182 being in its conducting state for a predetermined portion of each AC cycle. In response to the temperature setting of temperature setting device 178, timing circuit 186 generates corresponding timing signals for triggering triac 182 accordingly. Triac drive 190 receives the timing signals from timing circuit 186 and provides switching signals to gate terminal 187 of triac 182. The switching signals provided to gate terminal 187 maintain triac 182 in the conducting state for the predetermined portions of the AC sine wave cycles such that a predetermined amount of power is provided to heating element 12 during each AC cycle and heating element 12 heats electric blanket 11 to the user desired temperature setting.

If during operation of electric blanket 11, a user deactivates controller 160 by turning on/off switch 174 of heater control 168 to the off position, block 214, triac 182 returns to the non-conducting state such that AC current no longer flows through heating element 12 and electrical power is no longer supplied to heating structure 10, block 216. It is intended that electric blanket 11 be operational for a predetermined time period, e.g. twelve (12) hours, block 218. As such, it is contemplated that upon completion of the predetermined time period, timing circuit 186 generates a timing signal that instructs triac drive 190 to switch triac 182 to the non-conducting state such that AC current no longer flows through heating element 12 and electrical power is no longer supplied to heating structure 10, block 216.

Figure 7:
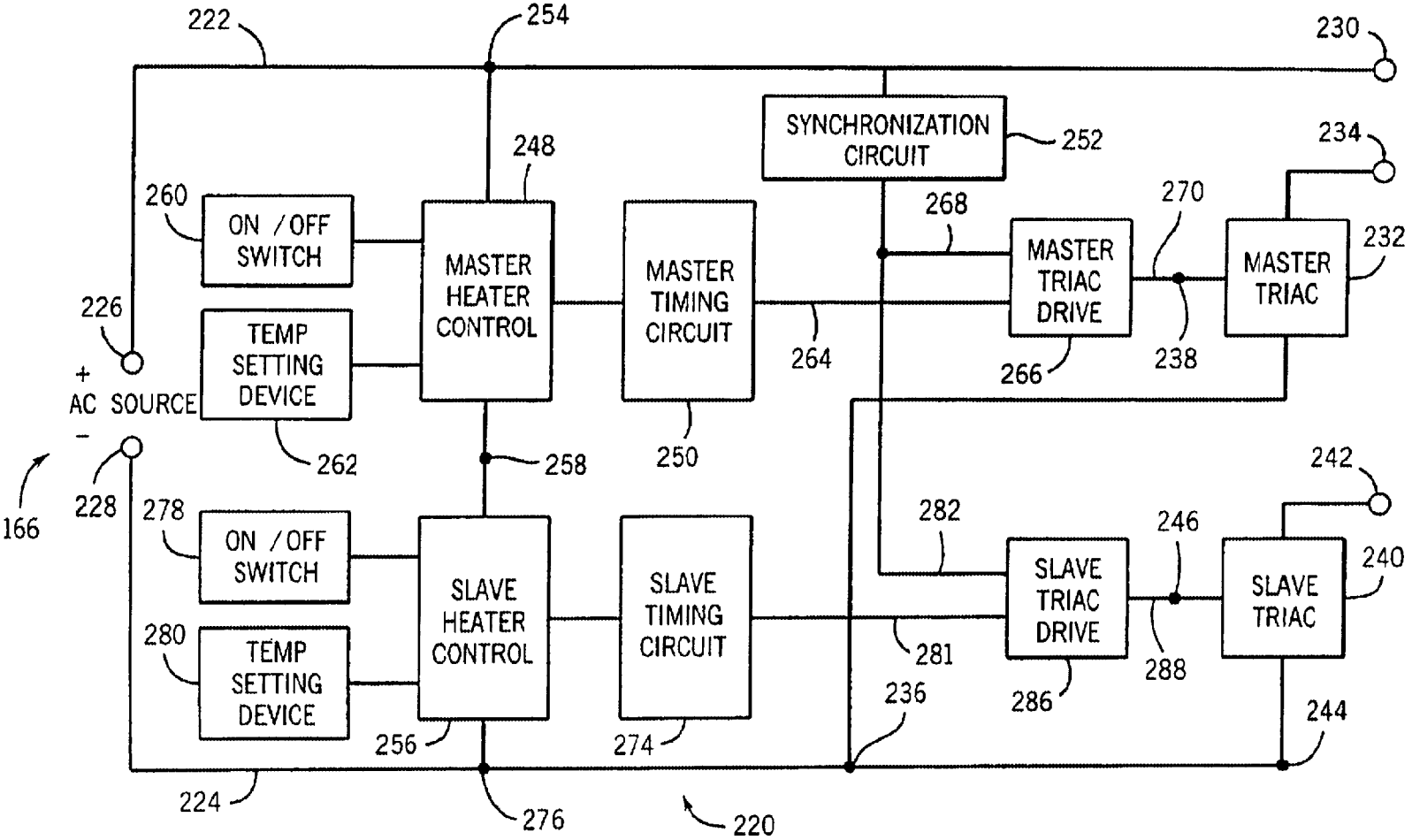
FIG. 7 is a schematic view of a controller for the heating structures of FIGS. 2–4.

Referring to FIG. 7, a controller for controlling operation of heating structures 30 and/or 91 of electric blanket 11 is generally designated by the reference numeral 220. Controller 220 includes lines 222 and 224 having first ends terminating at input terminals 226 and 228, respectively, that are connectable to a conventional AC power source 166. Line 222 of controller 220 has a second, opposite end 230 that is electrically coupled to a corresponding input 46 and 106 of heating structures 30 and 91, respectively.

Controller 220 further includes master triac 232 having first terminal 234 interconnected to a corresponding first side neutral line 50 and 110 of heating structures 30 and 91, respectively; second terminal 236 interconnected to line 224 of controller 220; and third gate terminal 238. Master triac 232 controls the flow of current between the first and second terminals 234 and 236, respectively, in response to a predetermined switching signals being provided at gate terminal 238. Master triac 232 has a first non-conducting state wherein master triac 232 acts like an open circuit and a second conducting state wherein master triac 232 electrically connects a corresponding first side neutral line 50 and 110 of heating structures 30 and 91, respectively, and line 224 and allows for the flow of current between first and second terminals 234 and 236, respectively, of master triac 232 during both alternations of an AC cycle. It can be appreciated that by controlling the flow of current through corresponding first heaters 32 and 92 of heating structures 30 and 91, respectively, the heat dissipated by first heaters 32 and 92, and hence, the temperature of a first side of electric blanket 11, may be controlled.

Controller 220 further includes slave triac 240 having first terminal 242 interconnected to a corresponding second side neutral line 80 and 130 of heating structures 30 and 91, respectively; second terminal 244 interconnected to line 224 of controller 220; and third gate terminal 246. Slave triac 232 controls the flow of current between the first and second terminals 242 and 244, respectively, in response to a predetermined switching signals provided at gate terminal 246. Slave triac 240 has a first non-conducting state wherein slave triac 240 acts like an open circuit and a second conducting state wherein slave triac 240 electrically connects a corresponding second side neutral line 80 and 130 of heating structures 30 and 91, respectively, and line 224 and allows for the flow of current between first and second terminals 242 and 244, respectively, of slave triac 240 during both alternations of an AC cycle. It can be appreciated that by controlling the flow of current through second heaters 34 and 94 of heating structures 30 and 91, respectively, the heat dissipated by second heaters 34 and 94, and hence, the temperature of a second side of electric blanket 11, may be controlled.

The switching signals for controlling operation of master triac 232 are generated by master heater control 248; master timing circuit 250; and synchronization circuit 252. Master heater control 248 is electrically connected to line 222 at node 254 and to slave heater control 256 at node 258. Master heater control 248 includes on/off switch 260 for allowing a user to actuate a corresponding first heater 32 and 92 of heating structures 30 and 91, respectively. In addition, master heater control 248 includes temperature setting device 262 for allowing a user to control the heat dissipated by a corresponding first heater 32 and 92 of heating structures 30 and 91, respectively, and hence, the temperature of the first side of electric blanket 11.

Master timing circuit 250 is operatively connected master heater control 248 and generates timing signals on line 264 in response to actuation of the on/off switch 260 and the temperature setting of temperature setting device 262. Synchronization circuit 252 is operatively connected to line 222 to monitor the zero crossing times of the electrical power supplied to a corresponding input 46 and 106 of heating structures 30 and 91, respectively, and provides such information as synchronizing signals to master triac drive 266 on line 268. Master triac drive 266 receives the timing signals from master timing circuit 250 on line 264 and the synchronizing signals from synchronization circuit 252 on line 268. Master triac drive 266 synchronizes the timing signals generated by master timing circuit 250 with the zero crossing times of the electrical power supplied the corresponding input 46 and 106 of heating structures 30 and 91, respectively, of electric blanket 11 and generates switching signals in response thereto. By synchronizing the timing signals generated by master timing circuit 250 with the zero crossing times of the electrical power, master triac drive 266 insures that the switching signals provided to gate terminal 238 of master triac 232 on line 270 trigger master triac 232 to the conductive state at equal positive or negative thresholds about the zero crossing times of the electrical power.

The switching signals for controlling operation of slave triac 240 are generated by slave heater control 256; slaver timing circuit 274; and synchronization circuit 252. Slave heater control 256 is electrically connected to master heating control 248 at node 258 and to line 224 at node 276. Slave heater control 256 includes on/off switch 278 for allowing a user to actuate a corresponding second heater 34 and 94 of heating structures 30 and 91, respectively, as hereinafter described. In addition, slave heater control 256 includes temperature setting device 280 for allowing a user to control the heat dissipated by a corresponding second heater 34 and 94 of heating structures 30 and 91, respectively, and hence, the temperature of the second side of electric blanket 11.

Slave timing circuit 274 is operatively connected slave heater control 256 and generates timing signals on line 281 in response to actuation of the on/off switch 278 and the temperature setting of temperature setting device 280. As heretofore described, synchronization circuit 252 is operatively connected to line 222 to monitor the zero crossing times of the electrical power supplied to a corresponding input 46 and 106 of heating structures 30 and 91, respectively, and provides such information as synchronizing signals to slave triac drive 286 on line 282. Slave triac drive 286 receives the timing signals from slave timing circuit 274 on line 281 and the synchronizing signals from synchronization circuit 252 on line 282. Slave triac drive 286 synchronizes the timing signals generated by slave timing circuit 274 with the zero crossing times of the electrical power supplied to a corresponding input 46 and 106 of heating structures 30 and 91, respectively, for electric blanket 11 and generates switching signals in response thereto. By synchronizing the timing signals generated by slave timing circuit 274 with the zero crossing times of the electrical power, slave triac drive 286 insures that the switching signals provided to gate terminal 246 of slave triac 240 on line 288 trigger slave triac 240 to the conductive state at equal positive or negative thresholds about the zero crossing times of the electrical power.

Figure 8:
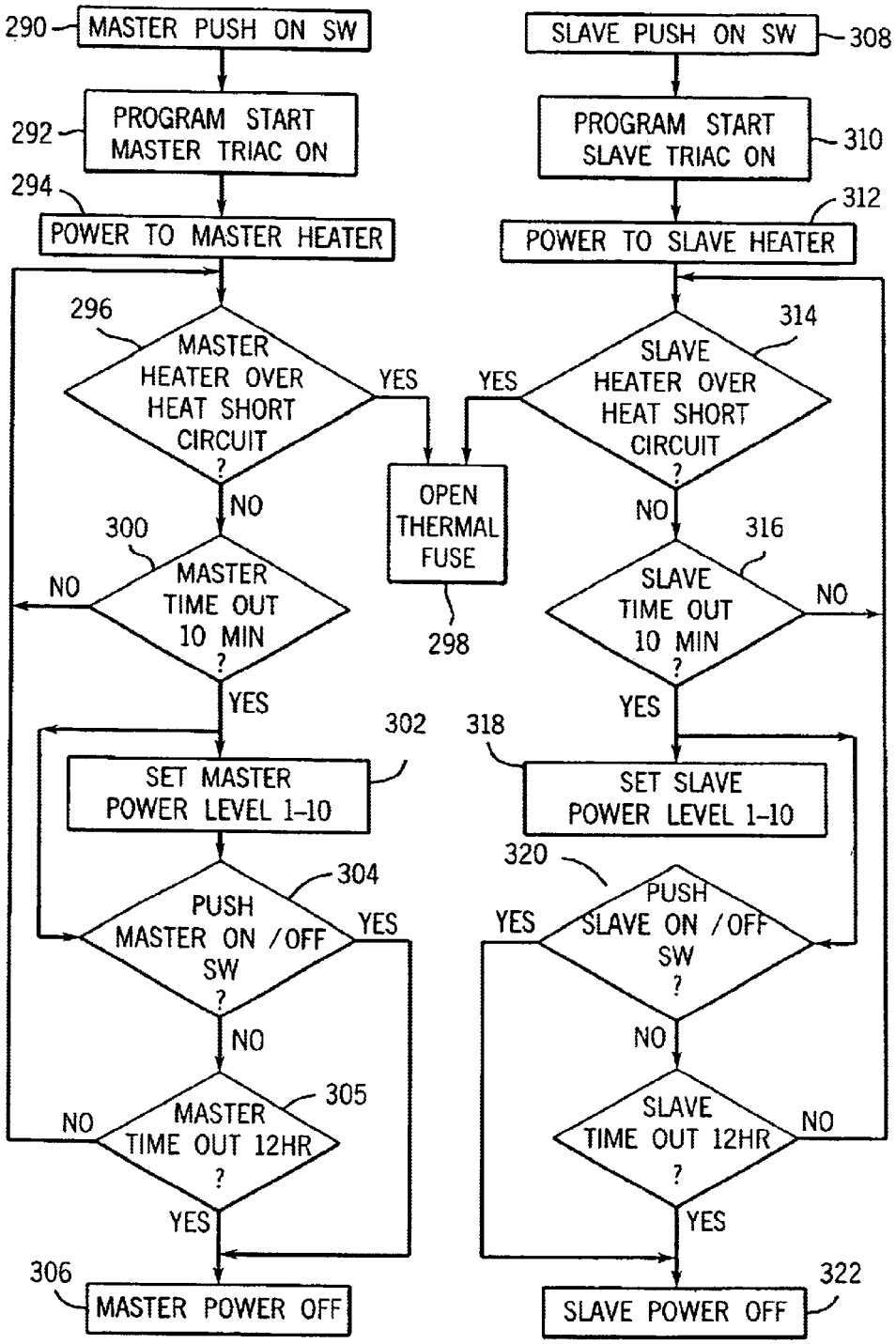
FIG. 8 is a flow chart of a method of controlling the heating structures of FIGS. 2–4.

Referring to FIG. 8, in operation, a user activates controller 220 by first actuating on/off switch 260 of master heater control 248 to the on position, block 290. With on/off switch 260 in the on position, master timing circuit 250 generates a corresponding timing signal instructing master triac drive 232 to trigger master triac 232 to the conducting state for a predetermined period of time, block 292, in order to allow for the flow of current through a corresponding first heater 32 and 92 of heating structure 30 and 91, respectively, to preheat the first side of electric blanket 11 to a minimum level, block 294. By way of example, master triac 232 may be maintained in the conducting state for a period often (10) minutes.

If heating structure 30 is provided in electric blanket 11 and an overheating situation occurs on the first side of electric blanket 11 such that the temperatures of outer core wires 38 or 40 of first heater 32 exceed the predetermined melting point of the insulation sheaths, block 296, the insulation sheaths about outer core wires 38 and 40 and central core wire 42 of first heater 32 melt such that outer core wires 38 and 40 of first heater 32 come into electrical contact with central core wire 42 of first heater 32 causing a short circuit. In response to a short circuit between the outer core wires 38 and 40 and central core wire 42 of first heater, AC current will flow through resistor-diode combinations 52 and 54 such that resistors R5 and R6, respectively, begin to dissipate heat. Thermal fuse 44 is tripped by the heat dissipated by resistors R5 and R6, as heretofore described, so as to create an open circuit between input 46 and node 62 thereby disconnecting first and second heaters 32 and 34, respectively, from the AC power source and terminating the overheating condition of electric blanket 11, block 298.

If heating structure 91 is provided in electric blanket 11 and an overheating situation occurs on the first side of the electric blanket 11 such that the temperatures of outer core wires 98 and 100 of first heater 92 exceed the predetermined melting point of the insulation sheaths, the insulation sheaths about outer core wires 98 and 100 and central core wire 102 of first heater 92 melt such that outer core wires 98 and 100 of first heater 92 come into electrical contact with central core wire 102 of first heater 92 causing a short circuit. In response to a short circuit between the outer core wires 98 and 100 and central core wire 102 of first heater 92, AC current will flow through resistor-diode combinations 132 and 134 such that resistors R9 and R10, respectively, begin to dissipate heat. Thermal fuse 104 is tripped by the heat dissipated by resistors R9 and R10, as heretofore described, so as to create an open circuit between input 106 and node 127 thereby disconnecting first and second heaters 92 and 94, respectively, from the AC power source and terminating the overheating condition of electric blanket 11, block 298.

If an overheating condition does not occur during the preheating time period, block 300, master timing circuit 250 monitors the temperature setting of temperature setting device 262, block 302. Each temperature setting corresponds to master triac 232 being in the conducting state for a predetermined portion of each AC cycle. In response to the temperature setting of temperature setting device 262, master timing circuit 250 generates corresponding timing signals for triggering master triac 232 accordingly. Master triac drive 266 receives the timing signals from master timing circuit 250 and provides switching signals to gate terminal 238 of master triac 232. The switching signals provided to gate terminal 238 maintain master triac 232 in the conducting state for the predetermined portions of the AC sine wave cycles such that a predetermined amount of power is provided to a corresponding first heater 32 and 92 of heating structures 30 and 91, respectively, during each AC cycle so as to heat first side of electric blanket 11 to the user desired temperature setting.

If during operation of electric blanket 11, a user deactivates controller 220 by turning on/off switch 260 of master heater control 248 to the off position, block 304, master triac 232 returns to the non-conducting state such that AC current no longer flows through a corresponding first heater 32 and 92 of heating structures 30 and 91, respectively, and electrical power is no longer supplied thereto, block 306. It is intended that electric blanket 11 be operational for a predetermined time period, e.g. twelve (12) hours, block 308. As such, it is contemplated that upon completion of the predetermined time period, master timing circuit 250 generates a timing signal that instructs master triac drive 266 to switch master triac 232 to the non-conducting state such that AC current no longer flows through a corresponding first heater 32 and 92 of heating structures 30 and 91, respectively, and electrical power is no longer supplied thereto, block 306.

If a user desires a second side of electric blanket 11 to be heated, the user actuates on/off switch 278 of slave heater control 256 to the on position, block 308. With on/off switch 278 in the on position, slave timing circuit 274 generates a corresponding timing signal instructing slave triac drive 286 to switch slave triac 240 to the conducting state for a predetermined period of time, block 310, in order to allow for the flow of current through a corresponding second heater 34 and 94 of heating structure 30 and 91, respectively, to preheat the second side of electric blanket 11 to a minimum level, block 312. By way of example, slave triac 232 may be maintained in the conducting state for a period often (10) minutes.

If heating structure 30 is provided in electric blanket 11 and an overheating situation occurs on the second side of the electric blanket such that the temperatures of outer core wires 68 and 70 of second heater 34 exceed the predetermined melting point of the insulation sheaths, block 314, the insulation sheaths about outer core wires 68 and 70 and central core wire 72 of second heater 34 melt such that outer core wires 68 and 70 of second heater 34 come into electrical contact with central core wire 72 of second heater 34 causing a short circuit. In response to a short circuit between the outer core wires 68 and 70 and central core wire 72 of second heater 34, AC current will flow through resistor-diode combinations 82 and 84 such that resistors R7 and R8, respectively, begin to dissipate heat. Thermal fuse 44 is tripped by the heat dissipated by resistors R7 and R8, as heretofore described, so as to create an open circuit between input 46 and node 62 thereby disconnecting first and second heaters 32 and 34, respectively, from the AC power source and terminating the overheating condition of electric blanket 11, block 298.

If heating structure 91 is provided in electric blanket 11 and an overheating situation occurs on the second side of the electric blanket such that the temperatures of outer core wires 118 and 120 of second heater 94 exceed the predetermined melting point of the insulation sheaths, the insulation sheaths about outer core wires 118 and 120 and central core wire 122 of second heater 94 melt such that outer core wires 118 and 120 of second heater 94 come into electrical contact with central core wire 122 of second heater 94 causing a short circuit. In response to a short circuit between the outer core wires 118 and 120 and central core wire 122 of second heater 94, AC current will flow through resistor-diode combinations 132 and 134 such that resistors R9 and R10, respectively, begin to dissipate heat. Thermal fuse 104 is tripped by the heat dissipated by resistors R9 and R10, as heretofore described, so as to create an open circuit between input 106 and node 127 thereby disconnecting first and second heaters 92 and 94, respectively, from the AC power source and terminating the overheating condition of electric blanket 11, block 298.

If an overheating condition does not occur during the preheating time period, block 316, slave timing circuit 274 monitors the temperature setting of temperature setting device 280, block 318. Each temperature setting corresponds to slave triac 240 being the conducting state for a predetermined portion of each AC cycle. In response to the temperature setting of temperature setting device 280, slave timing circuit 274 generates corresponding timing signals for triggering slave triac 240 accordingly. Slave triac drive 286 receives the timing signals from slave timing circuit 274 and provides switching signals to gate terminal 246 of slave triac 240. The switching signals provided to gate terminal 246 maintain slave triac 240 in the conducting state for the predetermined portions of the AC sine wave cycles such that a predetermined amount of power is provided to a corresponding second heater 34 and 94 of heating structures 30 and 91, respectively, during each AC cycle so as to heat second side of electric blanket 11 to the user desired temperature setting.

If during operation of electric blanket 11, a user depresses on/off switch 280 of slave heater control 256 to the off position, block 320, slave triac 240 returns to the non-conducting state such that AC current no longer flows through a corresponding second heater 34 and 94 of heating structures 30 and 91, respectively, and electrical power is no longer supplied thereto, block 322. It is intended that heating structure 30 or 91 provided in electric blanket 11 be operational for a predetermined time period, e.g. twelve (12) hours, block 324. As such, it is contemplated that upon completion of the predetermined time period, slave timing circuit 250 generates a timing signal that instructs slave triac drive 286 to switch slave triac 240 to the non-conducting state such that AC current no longer flows through a corresponding second heater 34 and 94 of heating structures 30 and 91, respectively, and electrical power is no longer supplied thereto, block 322.

Various modes of carrying out the invention are contemplated as being within the scope of the following claims particularly pointing and distinctly claiming the subject matter that is regarded as the invention.

We claim:

1. An electric blanket, comprising:

a first core wire having a first end and a second end;

a second core wire positioned adjacent the first core wire, the second core wire having first and second ends and engaging the first core wire in response to a predetermined temperature;

a cutout operatively connected to the first end of the first core wire, the cutout movable between a first connected state wherein the cutout electrically couples the first end of the first core wire to a variable power source and a second disconnected state wherein the cutout disconnects the first end of the first core wire from the variable power source; and a monitoring circuit operatively connected to the second core wire, the monitoring circuit moving the cutout between the connected state and the disconnected state in response to engagement of the second core wire and the first core wire and including:

a resistor and diode combination interconnecting the first end of the second core wire and a neutral point; and a second resistor and diode combination interconnecting the second end of the second core wire and the first end of the first coil wire.

2. The electric blanket of claim 1 wherein:

the first and second resistor and diode combinations are connected in series;

the diodes of the resistor and diode combinations have predetermined conductive directions; and the conductive directions of the diodes of the resistor and diode combinations are opposed.

3. The electric blanket of claim 1 wherein the cutout is positioned in close proximity to the resistors of the first and second resistor and diode combinations.

4. An electric blanket, comprising:

a first heater, including:

a first heating wire having a first end and a second end;

a second heating wire having a first end operatively connected to the second end of the first heating wire and a second end operatively connected to a first neutral point;

a monitoring wire positioned between the first and second heating wires, the monitoring wire engagable with the first and second heating wires in response to a predetermined temperature;

a cutout operatively connected to the first end of the first heating wire, the cutout movable between a first connected state wherein the cutout electrically couples the first end of the first heating wire to a variable power source and a second disconnected state wherein the cutout disconnects the first end of the first heating wire from the variable power source; and a monitoring circuit operatively connected to the monitoring wire, the monitoring circuit moving the cutout between the connected state and the disconnected state in response to engagement of the monitoring wire with one of the heating wires.

5. The electric blanket of claim 4 further comprising a second heater, the second heater including:

a first heating wire having a first end and a second end;

a second heating wire having a first end operatively connected to the second end of the first heating wire of the second heater and a second end operatively connected to a second neutral point; and a monitoring wire positioned between the first and second heating wires of the second heater, the monitoring wire of the second heater engagable with the first and second heating wires of the second heater in response to a predetermined temperature.

6. The electric blanket of claim 5 wherein the cutout is operatively connected to the first end of the first heating wire of the second heater such that with the cutout in the first connected state, the cutout electrically couples the first end of the first heating wire of the second heater to the variable power source and with the cutout in the second disconnected state, the cutout disconnects the first end of the first heating wire of the second heater from the variable power source.

7. The electric blanket of claim 5 further comprising a second monitoring circuit operatively connected to the monitoring wire of the second heater, the second monitoring circuit moving the cutout between the connected state and the disconnected state in response to engagement of the monitoring wire of the second heater with one of the heating wires of the second heater.

8. The electric blanket of claim 5 wherein the monitoring wire of the first heater has first and second ends and wherein the monitoring circuit includes:

a first resistor and diode combination interconnecting the first end of the monitoring wire of the first heater and the second neutral point, the resistor and the diode of the first resistor and diode combination are operatively connected at a node; and a second resistor and diode combination interconnecting the second end of the monitoring wire of the first heater and the first end of the first heating wire of the first heater.

9. The electric blanket of claim 8 wherein the monitoring wire of the second heater has first and second ends and wherein:

the first resistor and diode combination interconnects the first end of the monitoring wire of the second heater and the second neutral point; and the second resistor and diode combination interconnects the second end of the monitoring wire of the second heater and the first end of the first heating wire of the first heater.

10. The electric blanket of claim 9 wherein:

the first and second resistor and diode combinations are connected in series;

the diodes of the resistor and diode combinations have predetermined conductive directions; and the conductive directions of the diodes of the resistor and diode combinations are opposed.

11. The electric blanket of claim 10 further comprising a fault current diode having a predetermined conductive direction, the fault current diode interconnecting the first neutral point and the node.

12. The electric blanket of claim 11 wherein the conductive direction of the fault current diode and the conductive direction of the diode of the first resistor and diode combination are opposed.

13. An electric blanket connectable to a power source for providing voltage and current to thereto, comprising:

a first heater having a first end connectable to the power source and a second end connectable to a first neutral point, the first heater including first and second heating elements connected in series;

a first monitoring wire disposed between the first and second heating elements, the monitoring wire engagable with at least one of the heating elements in response to a predetermined temperature; and a monitoring circuit operatively connected to the first monitoring wire and to the power source, the monitoring circuit disconnecting the first heater from the power source in response to the first monitoring wire engaging the at least one of the heating elements.

14. The electric blanket of claim 13 further comprising:

a second heater having a first end connectable to the power source and a second end connectable to a second neutral point, the second heater including first and second heating elements connected in series; and a second monitoring wire disposed between the first and second heating elements of the second heater, the second monitoring wire engagable with at least one of the heating elements of the second heater in response to a predetermined temperature.

15. The electric blanket of claim 14 further comprising a second monitoring circuit operatively connected to the second monitoring wire and to the power source, the second monitoring circuit disconnecting the first heater from the power source in response to the second monitoring wire engaging the at least one of the heating elements of the second heater.

16. The electric blanket of claim 14 wherein:

the first end of the first heater and the first end of the second heater are operatively connected at a heater node;

the first end of the first monitoring wire and the first end of the second monitoring wire are operatively connected at a first monitoring wire node; and the second end of the first monitoring wire and the second end of the second monitoring wire are operatively connected at a second monitoring wire node.

17. The electric blanket of claim 16 wherein the monitoring circuit includes:

a first resistor and diode combination interconnecting the first monitoring wire node and the second neutral point, the resistor and the diode of the first resistor and diode combination operatively connected at a resistor-diode node; and a second resistor and diode combination interconnecting the second monitoring wire node and the heater node.

18. The electric blanket of claim 17 wherein:

the first and second resistor and diode combinations are connected in series;

the diodes of the resistor and diode combinations have predetermined conductive directions; and the conductive directions of the diodes of the resistor and diode combinations are opposed.

19. The electric blanket of claim 18 further comprising a fault current diode having a predetermined conductive direction, the fault current diode interconnecting the first neutral point and resistor-diode node.

20. The electric blanket of claim 19 wherein the conductive direction of the fault current diode and the conductive direction of the diode of the first resistor and diode combination are opposed.

21. An electric blanket, comprising:

a first core wire having a first end and a second end;

a second core wire positioned adjacent the first core wire, the second core wire engaging the first core wire in response to a predetermined temperature;

a cutout operatively connected to the first end of the first core wire, the cutout movable between a first connected state wherein the cutout electrically couples the first end of the first core wire to a variable power source and a second disconnected state wherein the cutout disconnects the first end of the first core wire from the variable power source;

a third core wire positioned adjacent the second core wire, the third core wire having a first end operatively connected to the second end of the first core wire and a second end operatively connected to a neutral point; and a monitoring circuit operatively connected to the second core wire, the monitoring circuit moving the cutout between the connected state and the disconnected state in response to engagement of the second core wire and the first core wire.

22. The electric blanket of claim 21 wherein the first and the second core wires are wrapped in insulation, the insulation melting in response to exposure to the predetermined temperature.

23. The electric blanket of claim 21 wherein the monitoring circuit moves the cutout between the connected state and the disconnected state in response to engagement of the second core wire and the third core wire.

24. The electric blanket of claim 21 wherein the cutout includes a thermal fuse.

* * * * *